US008938903B2

(12) United States Patent
Larue

(10) Patent No.: US 8,938,903 B2
(45) Date of Patent: Jan. 27, 2015

(54) FIREARM BARREL HAVING CARTRIDGE CHAMBER PREPARATION FACILITATING EFFICIENT CARTRIDGE CASE EXTRACTION AND PROTECTION AGAINST PREMATURE BOLT FAILURE

(76) Inventor: Mark C. Larue, Leander, TX (US)

( * ) Notice: Subject to any disclaimer, the term of this patent is extended or adjusted under 35 U.S.C. 154(b) by 208 days.

(21) Appl. No.: 13/507,422

(22) Filed: Jun. 27, 2012

(65) Prior Publication Data

US 2014/0075805 A1 Mar. 20, 2014

Related U.S. Application Data

(60) Provisional application No. 61/572,082, filed on Jul. 11, 2011, provisional application No. 61/573,904, filed on Sep. 14, 2011.

(51) Int. Cl.
*F41A 21/12* (2006.01)
*F41A 15/14* (2006.01)

(52) U.S. Cl.
CPC *F41A 21/12* (2013.01); *F41A 15/14* (2013.01)
USPC ..... 42/76.01; 42/78; 42/2; 89/14.05; 89/14.7

(58) Field of Classification Search
USPC ..... 42/76.01, 78, 2; 89/14.05, 14.7
See application file for complete search history.

(56) References Cited

U.S. PATENT DOCUMENTS

| | | | | |
|---|---|---|---|---|
| 45,898 | A * | 1/1865 | Berdan | 42/78 |
| 3,736,693 | A * | 6/1973 | Koch | 42/78 |
| 4,006,000 | A * | 2/1977 | Tortorici et al. | 55/323 |
| 5,479,737 | A * | 1/1996 | Osborne et al. | 42/76.01 |

* cited by examiner

*Primary Examiner* — J. Woodrow Eldred
(74) *Attorney, Agent, or Firm* — James L. Jackson

(57) ABSTRACT

To permit ease and efficiency for the extraction of spent cartridge cases from the cartridge chamber of a firearm barrel within a wide range of temperature conditions, the internal tapered surface of the body region of a cartridge chamber is prepared by establishing circumferentially spaced longitudinal straight or curved regions of the internal surface finish to create an internal cartridge chamber geometry having gradually tapered spaced longitudinally relieved linear or spiral areas having longitudinal linear or spiral lands between each of the relieved areas. The circumferentially spaced lands develop controlled impedance to rearward cartridge case movement on cartridge firing to effectively protect the bolt and extractor mechanisms of the firearm against early failure.

19 Claims, 3 Drawing Sheets

FIREARM BARREL HAVING CARTRIDGE CHAMBER PREPARATION FACILITATING EFFICIENT CARTRIDGE CASE EXTRACTION AND PROTECTION AGAINST PREMATURE BOLT FAILURE

RELATED PROVISIONAL APPLICATIONS

Applicant hereby claims the benefit of U.S. Provisional Patent Application No. 61/572,082 filed on Jul. 11, 2011 by Mark C. LaRue and entitled "Firearm Barrel Having Cartridge Chamber Preparation Facilitating Efficient Cartridge Case Extraction", and U.S. Provisional Patent Application No. 61/573,904 filed on Sep. 14, 2011 by Mark C. LaRue and entitled "Firearm Barrel Having Cartridge Chamber Preparation Facilitating Efficient Cartridge Case Extraction And Protection Against Premature Bolt Failure", which Provisional patent applications are incorporated by reference herein for all purposes.

BACKGROUND OF THE INVENTION

1. Field of the Invention

The present invention relates generally to automatic or semi-automatic firearms that incorporate a firearm barrel having a bore and having a cartridge chamber machined or otherwise formed within the barrel and being in communication with the bore. More particularly, the present invention concerns a cartridge chamber of a firearm barrel having internal wall treatment that facilitates the need for minimal extraction force during extraction of cartridge cases following the firing of cartridges. Even more specifically, the present invention concerns a method or process for generating an internal cartridge chamber surface that significantly reduces the surface contact area of the external tapered body surface of a cartridge case with the internal tapered surface of the cartridge chamber as compared with standard cartridge chambers. This invention also concerns cartridge chamber preparation for firearm barrels that ensure enhanced service life of the cartridge extractor and bolt mechanism of automatic and semi-automatic firearms.

2. Description of the Prior Art

The problem of cartridge case sticking has existed since about 1903 when ammunition having metal cartridge cases was initially developed for use in early machine guns. This problem has continued to plague the various manufacturers and users of firearms such as automatic and semi-automatic rifles, machine guns, artillery pieces, shotguns, in fact virtually every type of firearm that employs ammunition having a case that may be composed of metal, paper, polymer or a composite of various materials and is received within a chamber having a matching internal geometry with the external geometry of the cartridge case or shell case. The present invention is discussed herein particularly as it relates to small arms, such as rifles, machine guns and the like, but it is not intended to limit the spirit and scope of the present invention solely to these specific types of firearms, since the invention is readily applicable to a wide range of firearms and types of ammunition.

Most cartridge chambers are sized, relative to the cartridge case of the round to be fired, such that the cartridge can be easily inserted into the chamber. However, the fit of the cartridge case within the cartridge chamber must ensure that the cartridge case is maintained at a precise position in axial alignment with the bore of the barrel to ensure accuracy of firing. When a cartridge is discharged, such as by igniting gun powder within the cartridge case by striking a primer of the cartridge with a firing pin of a firearm, the rapidly burning gun power instantly generates high pressure within the cartridge case. This high pressure, which can be in the order of 50,000 psi or greater, ejects the bullet or other type of round from the neck of the cartridge case and propels it through the bore of the barrel toward the muzzle end of the firearm barrel. As a bullet is propelled by the substantially instantaneous high pressure of the cartridge gas, the high gas pressure acts rearwardly and instantaneously on the cartridge case, tending to drive the cartridge case and the bolt member rearwardly. This sudden rearwardly directed gas pressure induced force causes the bolt and extractor of a firearm to be subjected to significant instantaneous stress, which can cause premature failure of the bolt and/or extractor. The cartridge case, having been expanded by gas pressure to a tight fit within the cartridge chamber, tends to stick and resists initial rearward movement by the extractor, thus subjecting the extractor to significant instantaneous stress. When the cartridge gas pressure dissipates, the elastic memory of the cartridge case material will retract the cartridge case from its tight fit within the cartridge chamber, minimizing the extraction force that is necessary to extract the cartridge case of the spent cartridge from the cartridge chamber. Therefore, it is desirable to provide the cartridge chamber of a firearm barrel with internal surface preparation that develops controlled impedance to cartridge case extraction movement from the cartridge chamber and ensures the extended service life of both the extractor and bolt mechanisms of automatic and semi-automatic firearms. The controlled impedance is accomplished by minimizing the surface area contact of the external surface area of a cartridge case with the internal surface area of a cartridge chamber. This feature minimizes the gripping or frictional resistance of the internal spiral lands that compose a part of the internal surface geometry of the cartridge chamber with the external surface of a cartridge case. The degree of impedance is controlled by the dimensions of the internal spiral lands and by the geometry and orientation of the spiral lands and relief areas within the cartridge chamber.

The high pressure of gun powder combustion within the cartridge case causes expansion of the cartridge case and also causes minimal expansion of that portion of the firearm barrel that surrounds the cartridge chamber. The cartridge case, being composed of a yieldable material such as relatively thin brass, relatively thin steel, paper, polymer or various composites is deformed by the high internal pressure of cartridge gas so that it is urged outwardly and into relatively tight fitting relation with the internal surface of the cartridge chamber when the round is fired. When the cartridge case is in this pressure expanded tight fitting condition within the cartridge chamber it essentially establishes a friction resistance or gripping relation with the internal wall surface of the cartridge chamber. If, at this point, the extractor mechanism of the firearm should apply an extracting force to the pressure expanded cartridge case, the gripping relation of the cartridge case with the internal wall surface of the cartridge chamber will likely retard its extraction or will require a large extraction force to overcome this wall gripping relation and permit the extractor to begin extracting the cartridge case from the chamber. This large extraction force causes accelerated stress induced wear of the extractor mechanism and often results in breakage of the extractor, thus rendering the firearm inoperative.

In some cases the large extraction force will cause the cartridge case gripping portion of the extractor to yield the typically soft metal of the cartridge case and pull through its rearmost rim. Obviously, this condition leaves the stuck cartridge case within the chamber and requires the firearm user to insert a cleaning rod or similar implement through the bore of the barrel and push the cartridge case from the chamber. Efficient cartridge case extraction and ejection is necessary for virtually all automatic and semi-automatic firearms, and since these types of firearms are widely used by military and law enforcement personnel, a firearm that is rendered inoperative because of cartridge case extraction problems can subject the user to a dangerous condition. Moreover, tactical firearms must have the capability for operating efficiently over a wide temperature range and a wide variety of field conditions while experiencing minimal problems from the standpoint of cartridge case extraction and ejection.

The high pressure condition within the cartridge case will begin to be depleted as the bullet or other charge is propelled through the barrel bore and becomes depleted rapidly when the bullet leaves the muzzle of the barrel. When this occurs the minimally expanded portion of the barrel will rapidly return to its original condition and the cartridge case will begin returning from a pressure expanded condition substantially to its normal condition or geometry. After the cartridge case has become sufficiently contracted to diminish the gripping relation between the cartridge case and the cartridge chamber wall the cartridge case will be in a condition for easy extraction.

When used in automatic and semi-automatic firearms such as machine guns and tactical rifles, it is appropriate for the firearm mechanism to fire a round, extract and eject the spent cartridge case, and to charge the cartridge chamber with a fresh cartridge in the shortest possible period of time. Often, the timing of this process causes the extractor of the firearm to be applying significant pulling or extracting force on the spent cartridge case before contraction of the expanded cartridge case has progressed sufficiently to sufficiently diminish the frictional resistance and permit the cartridge case to be extracted by normal extraction force. This condition often causes excessive wear or mechanical failure of the extractor or causes the extractor to pull through the rim of the cartridge case. Therefore, it is desirable to provide for ease of extraction of cartridge cases even under conditions where the pressure expanded cartridge case has not yet returned to its retracted or relaxed state as cartridge gas pressure is being depleted.

Attempts were made many years ago to achieve substantially balanced gas pressure internally and externally of a spent cartridge case by fluting, i.e., internal longitudinal grooves that extend to the forward most end of the cartridge chamber. Fluting within a cartridge chamber permits gas pressure to be channeled within the cartridge chamber and externally of a spent cartridge case to provide a pressure balancing feature. Fluting permits the presence of cartridge gas pressure both internally and externally of the spent cartridge case causing the cartridge case to contract more quickly so that it may be extracted more easily. Channeling of cartridge gas pressure around the forward end of the cartridge case causes the differential pressure across the wall of the cartridge case to become substantially balanced. This pressure balancing activity quickly reduces the gripping relation of the spent cartridge case with the internal wall surface of the cartridge chamber and permits ease of cartridge case extraction. Examples of fluted cartridge chambers to promote gas pressure balancing are indicated by U.S. Pat. No. 2,383,356 of Wilson, U.S. Pat. No. 2,464,323 of Lee, U.S. Pat. No. 4,066,000 of Rostoeil and U.S. Pat. No. 5,479,737 of Osborne et al When a round is fired by a firearm having a fluted cartridge chamber internal gas pressure will quickly expand the cartridge case against the internal wall surfaces of the cartridge chamber. As soon as the bullet of the cartridge is ejected from the cartridge case by the pressure expansion of gun powder ignition, gas pressure will enter the longitudinal flutes of the cartridge chamber and flow externally of the cartridge case, between the external surface of the cartridge case and the internal cartridge support wall surface of the cartridge chamber, toward the rearmost portion of the cartridge case. This external pressure counteracts the pressure within the cartridge case and minimizes the pressure differential that would otherwise exist across the wall of the cartridge case, thus establishing substantial pressure balancing and minimize the friction or gripping force that would otherwise prevent or delay cartridge case extraction from the cartridge chamber. This pressure balancing activity minimizes the period of time during which the cartridge case will be sufficiently expanded to have an extraction resisting gripping relation with the internal surface of the cartridge chamber and promotes rapid firing activity. However, this rapid firing capability is gained at the cost of fouling the cartridge chamber with gun powder residue and potentially damaging the cartridge cases.

A primary disadvantage of the fluted chamber method for balancing cartridge gas pressure is that a substantial amount of gun powder debris is typically generated during burning of the gun powder. A substantial amount of this cartridge gas debris is transported into the fluting grooves of the cartridge chamber externally of the cartridge case and constitutes fouling material which, if not removed by thorough cleaning, will build up in the cartridge chamber to the point that the firearm will have difficulty functioning and may cease to function normally.

Many firearm users regularly re-load their ammunition by recovering spent cartridge cases, subjecting the cartridge cases to cleaning, removing and replacing the spent primer, adding a measured amount of gun powder and seating a bullet in the neck of the cartridge case. Many firearm users conduct tests with particular rifles, particular types of cartridge cases, bullets and gun powder to develop a load that has extreme accuracy with that particular rifle.

When a cartridge chamber is grooved or fluted, the pressure of gun powder ignition will cause the cartridge case to be deformed into the grooves or flutes. This deformation often causes the cartridge cases to be un-useable for purposes of re-loading. A fluted cartridge chamber will also cause the debris of the burned gun powder to coat and foul the external surfaces of cartridge cases, sometimes to the point that the cartridge cases will be fouled and damaged such that reloading becomes impossible or impractical. Therefore, it is desirable to provide a novel method and process for minimizing the force that is necessary for spent cartridge case extraction while ensuring that little or no cartridge gas pressure will be permitted to enter the cartridge chamber externally of the cartridge case upon firing of a cartridge. This feature prevents or significantly minimizes the presence of debris within the cartridge chamber and externally of the cartridge cases, and permits the spent cartridge cases to be extracted and ejected in a clean condition so that it may be simply and efficiently reloaded many times if desired.

Many autoloading firearm mechanisms employ a cartridge gas pressure responsive bolt mechanism which is driven rearwardly by cartridge gas pressure that is either applied directly to a bolt mechanism or is tapped from the barrel well forwardly of the cartridge chamber. Cartridge gas pressure entering from a port in the barrel will be applied to a piston and develop a piston force that achieves rearward movement of a bolt mechanism. As the bolt is moved rearwardly its extractor, being engaged with the rear rim of the cartridge that has been fired, will apply a rearward force to the cartridge rim, extracting the spent cartridge from the cartridge chamber. If the spent cartridge case is still in tight engagement with the internal support wall surfaces of the cartridge chamber, the extractor may not be able to extract the spent cartridge case. Under this condition the extractor can be pulled through the soft metal rim of the cartridge case, leaving the firearm inoperative until the spent cartridge case has been cleared from the cartridge chamber. The extractor may actually pull the rim portion of the cartridge case from the cartridge case body. This condition would also render the firearm inoperative until the remaining portion of the cartridge case has been cleared from the chamber. Therefore, it is desirable to provide a technology that minimizes the extraction force that is needed to extract a spent cartridge case without damaging it, even under circumstances where the cartridge case has not yet contracted to a normal condition for extraction after having been fired.

The longitudinal relieved areas are generated by removing by machining or by other processes, portions of the original reamed internal surface in the range of from about 0.0001" to about 0.0010" and constitute from about ⅔ to ¾ of the internal surface area of the tapered body support portion of the cartridge chamber while the longitudinal lands comprise about ⅓ to ¼ of the original internal surface area of the cartridge chamber. The neck portion of a cartridge case will establish an effective seal with the corresponding internal neck support surface of the cartridge chamber, thus preventing or substantially minimizing incursion of cartridge gas pressure between the cartridge case and the internal wall surface of the cartridge chamber.

A significant number of firearms have no cartridge case extraction mechanisms, but employ cartridge gas pressure to accomplish cartridge extraction from the cartridge chamber. When a cartridge is fired, its internal gas pressure acts both to propel the bullet from the cartridge case and to propel the cartridge case rearwardly. Typically, these types of firearms also employ cartridge gas pressure to overcome the mass of the bolt and the force of a bolt operating spring and propel the bolt of the firearm rearwardly. An ejector will then accomplish stripping of the spent cartridge case from the rearwardly moving bolt mechanism and will introduce a lateral force to eject the spent cartridge case from the receiver mechanism of the firearm. The bolt, after its rearward movement has ceased, will be driven forwardly by the bolt operating spring, retrieving a fresh cartridge from a magazine and moving the fresh cartridge into the cartridge chamber of the barrel in readiness for firing.

Both cartridge gas operated and recoil operated automatic and semi-automatic firearms have a common problem from the standpoint of bolt failure. When a cartridge is fired the cartridge case will instantly be driven rearwardly and will impart significant sharp and dynamic impact to the bolt mechanism. This sudden bolt thrust initiates bolt unlocking and rearward bolt movement and imparts significant stress to the bolt mechanism. The sudden bolt stress, which is repeated when each subsequent cartridge is fired, is a principal cause of early bolt failure. It is desirable, therefore, to provide a suitable means for introducing controlled impedance to cartridge case movement at the time of bullet launch, to thus minimize premature failure of the bolt mechanism.

SUMMARY OF THE INVENTION

It is a principal feature of the present invention to provide a novel cartridge chamber geometry within a firearm barrel which minimizes the extraction force that is required to extract a spent cartridge case from the cartridge chamber;

It is another feature of the present invention to provide a novel method for generating a geometry within a tapered body wall surface of a cartridge chamber that minimizes case extraction force and promotes an effective gas seal to minimize the presence of cartridge gas pressure and debris externally of the cartridge case;

It is also a feature of the present invention to provide novel body surface geometry within the cartridge chamber of a firearm barrel that reduces cartridge case contact with the internal body wall surface of a cartridge chamber as compared with conventional cartridge chambers and consequently reduces the extraction force that is required to extract and eject a spent cartridge case after the firing of a round of ammunition; and It is another feature of the present invention to provide cartridge chamber preparation, which provides controlled impedance to cartridge case movement at the time of bullet launch to minimize premature failure of the bolt mechanism due to the stress of cartridge case thrust against the bolt when a cartridge is fired.

Briefly, the various objects and features of the present invention are realized through the provision of a firearm barrel, for any type of firearm, including rifles, machine guns, artillery pieces, etc. which employ ammunition having a metal case and is inserted into a cartridge chamber for firing. The present invention is discussed herein particularly as it relates to barrels and cartridge chambers for automatic or semi-automatic firearms, particularly tactical firearms, such as rifles, though it is not intended to limit the present invention to any particular type of firearm. Within the barrel is formed a cartridge chamber having a tapered shoulder support portion and a neck support portion that each have a circular cross-sectional configuration so that the neck and shoulder portions of a cartridge case will establish an effective seal with the corresponding internal support surfaces within the cartridge chamber, thus preventing or substantially minimizing incursion of cartridge gas pressure into the interface between the cartridge case and the internal wall surface of the cartridge chamber. Conventional cartridge chambers are typically formed by a reaming operation and have a gradually tapered cartridge body support surface, of circular cross-section, that extends from a cartridge base support section to the tapered cartridge shoulder support surface.

To promote extraction of spent cartridge cases under a wide variety of conditions, temperature ranges, etc., the internal tapered surface of a conventional cartridge chamber is prepared by generating longitudinal circumferentially spaced relieved areas having longitudinal lands between each of the relieved areas, the longitudinal lands being defined by the original internal reamed cartridge body support surface of the cartridge chamber. The longitudinal relieved areas are generated by removing, by machining, or by other processes, portions of the original reamed internal surface to a maximum depth in the range of from about 0.0003" to about 0.0010" and constituting from about ⅔ to about ¾ of the internal surface area of the tapered body support portion of the cartridge chamber. The remaining longitudinal lands comprise about ⅓ to ¼ of the original internal tapered cartridge body support surface area of the cartridge chamber. The tapered internal body support surface portion of the cartridge chamber is prepared with spaced longitudinal internal very shallow relieved or scalloped regions that may be of straight configuration but are preferably of generally arcuate or spiral configuration. In essence the overall internal surface area of a cartridge chamber is enlarged by the circumferentially spaced relieved regions to effectively decrease the area of contact between the external surface of a cartridge case and the internal cartridge body support surface of the cartridge chamber. After formation of the relieved or scalloped areas within the cartridge chamber only the longitudinal lands, which have a smaller surface area, in the range of from about ¼ to ⅓ of the tapered internal surface area of the cartridge chamber will engage the cartridge case. This feature reduces the friction resisting area of the cartridge chamber by ⅔ to ¾ and permits a spent cartridge case to be extracted with much less extraction force. The cartridge cases also tend to scrub the surfaces of the internal spaced lands during cartridge case movement, thus maintaining them substantially free of residue build-up. These features thus enables cartridge cases to be extracted during times when the cartridge case has not yet fully contracted from the pressure expanded condition that occurs during firing. Moreover, a small quantity of air is present with the relieved areas between the cartridge chamber surfaces and the external surface of a cartridge case. During cartridge case expansion by cartridge gas pressure this small quantity of air is compressed as the cartridge case is expanded and functions as a cushion or as an air spring which urges the cartridge case to return from its gas pressure expanded condition to its contracted or normal condition.

To minimize the potential for premature bolt failure by the stress that is transmitted to the bolt mechanism by cartridge firing and cartridge case travel during extraction, the ridges and relieved regions of the cartridge chamber are provided with a spiral geometry. The spiral geometry tends to impart a rotary force moment to a cartridge case being extracted, i.e., pulled linearly by the extractor, thus serving as impedance or resistance to free or uncontrolled movement. The tightness of the internal spiral geometry of the cartridge chamber is controlled by the dimension and geometry of the circumferentially spaced relief regions and the circumferentially spaced lands to thus provide the degree of resistance or impedance to cartridge case movement that is appropriate to minimize bolt stress and premature bolt and extractor failure.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings

FIG. 1 is an isometric illustration showing a firearm barrel having a cartridge chamber embodying the principles of the present invention and representing the preferred embodiment of the invention;

FIG. 2 is a partial end view of the firearm barrel of FIG. 1 showing the circled part of the cartridge chamber end of FIG. 1 in greater detail;

FIG. 3 is a longitudinal section view taken along line 3-3 of FIG. 4, showing the firearm barrel of FIG. 1, relative to autoloading firearm components, such as a receiver and barrel retainer nut, with part thereof broken away, and further showing a cartridge chamber within the barrel that is formed by cartridge case extraction technology embodying the principles of the present invention;

Figure 1:
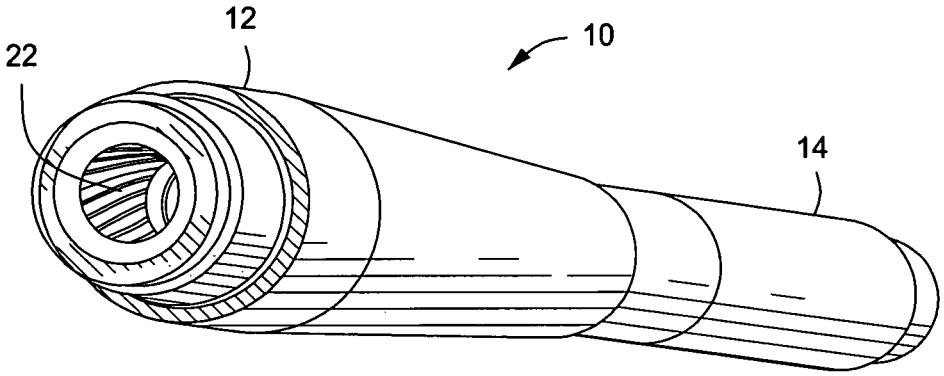
Figure 3:
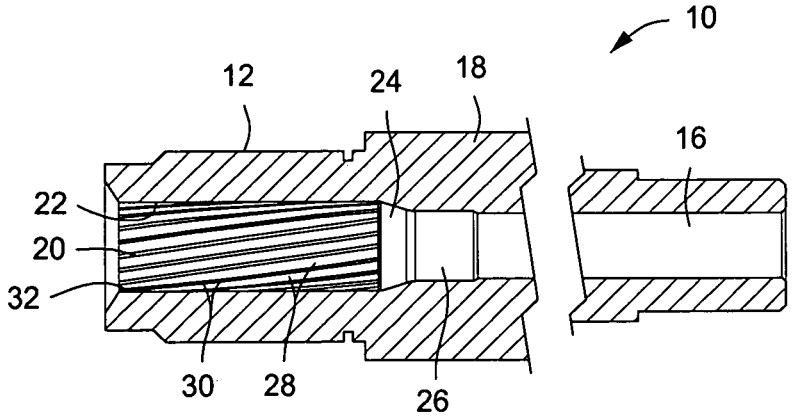
Figure 3A:
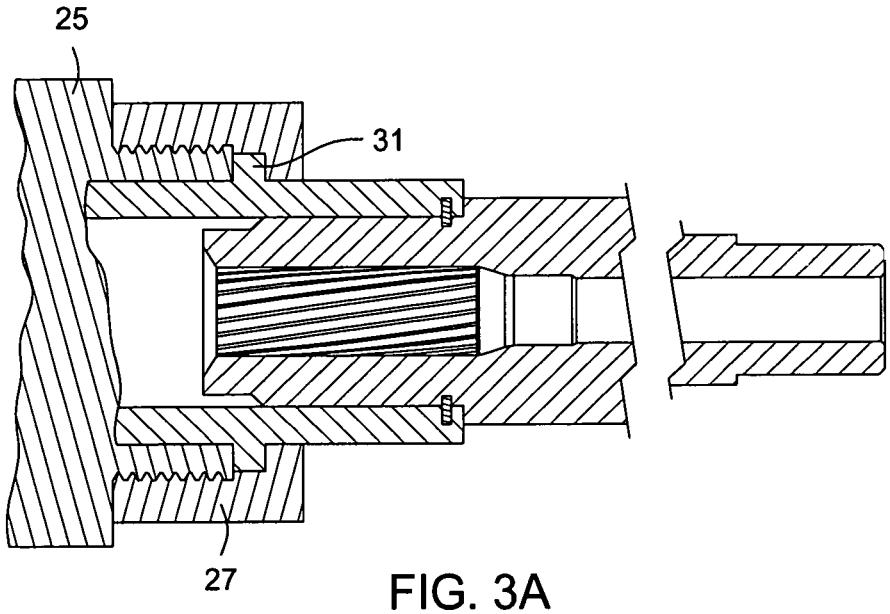
Figure 4:
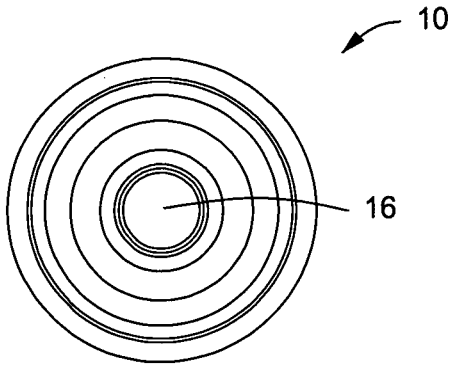
Figure 5:
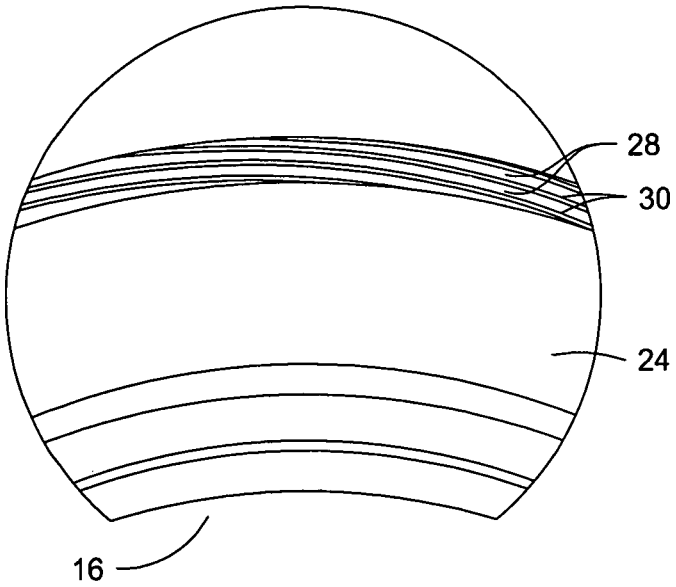

FIG. 4 is an end elevation view of the firearm barrel of FIGS. 1 and 3 which is taken along line 4-4 of FIG. 3; and FIG. 5 is a fragmentary end elevation view of that part of the firearm barrel shown within an orientation circle in FIG. 4 and being greatly enlarged to show the presence of internal scalloped or relieved regions within the tapered cartridge case body support portion of the internal wall surface of the cartridge chamber.

DETAILED DESCRIPTION OF PREFERRED EMBODIMENT

Figure 2:
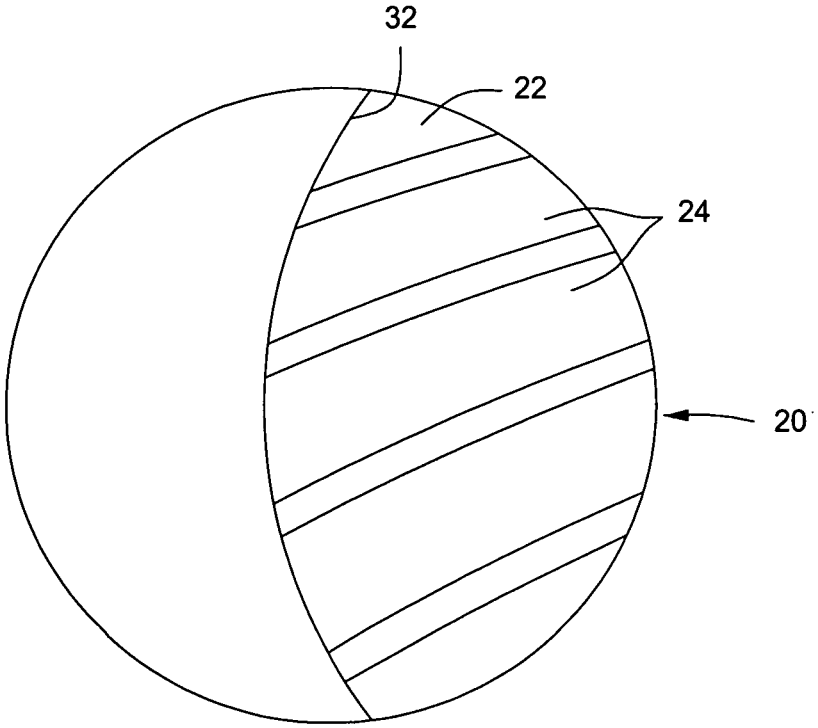

Referring now to the drawings and first to FIG. 1-3, a firearm barrel is shown generally at 10 and defines a cartridge chamber extremity 12 and a muzzle extremity 14. The barrel 10 defines an internal bore 16, as shown in FIG. 3 which is preferably defined by helical lands and grooves, generally referred to as rifling. For the purpose of simplicity the rifling is not shown and an intermediate portion of the barrel is cut away. The barrel 10 is generally defined by wall structure 18 which is quite thick in the region of the cartridge chamber extremity 12 so that the barrel structure will be capable of withstanding the sudden increase of internal gas pressure during the firing of cartridges.

Within the cartridge chamber extremity 12 of the barrel a cartridge chamber is defined as shown generally at 20 and is of an internal geometric form that substantially matches the external geometry of a cartridge that is handled by the firearm. The cartridge chamber 20 is defined by an internal wall surface 22 which is of tapered configuration extending from an internal cartridge rim support surface 32 to an abrupt tapered shoulder surface 24, thus matching the taper of the external surface of the body portion of a cartridge case. The cartridge chamber also defined a generally cylindrical neck support surface 23 that provides for support and surface to surface sealing of a cartridge case within the cartridge chamber. As shown in FIG. 3, the barrel 10 is shown to be supported from a receiver structure 25 of a firearm by means of a barrel retainer nut 27 which is threaded to an extension 29 of the firearm receiver and bears against an, annular barrel retainer flange 31 that is integral with and projects radially outwardly from the cartridge chamber extremity 12 of the barrel 10. A handguard structure, not shown, is typically mounted to the receiver and defines a chamber within which a majority of the barrel 10 is located. The barrel is spaced from the wall structure of the handguard, so that heat from the barrel will not be conducted from the barrel through the handguard material to a firearm supporting hand of the user.

As mentioned above, most cartridges for small arms, such as rifles and machine guns have cartridge cases that are composed of a rather soft metal such as brass. A cartridge case is typically subject to high internal pressure, in the order of 50,000 psi as the gun powder charge of the cartridge is ignited, and thus the cartridge case is supported against excessive expansion by the internal tapered body support wall or surface 22 of the cartridge chamber. However, when a cartridge is fired the cartridge cases will be expanded, causing the external surface thereof to tightly engage the tapered body support wall or surface 22. This degree of pressure induced expansion, however, is controlled by chamber wall support such that it will not exceed the elastic limit of the cartridge case material. Thus, when the cartridge gas pressure is being depleted by exiting the firearm barrel at the muzzle, the cartridge case, due to its elastic memory, will quickly return substantially to its original configuration, becoming somewhat loose, or retained within the cartridge chamber by minimal friction or surface gripping force, so that it can be extracted quite easily by the cartridge case extractor mechanism of the firearm. As the cartridge case approaches its contraction from a completely expanded state to a completely contracted or relaxed state within the cartridge chamber, it typically can be extracted from the cartridge chamber and ejected.

As indicated above, for tactical use of a firearm, it is desirable that the firearm mechanism be capable of extracting spent cartridge cases and being recharged with a fresh cartridge from a magazine as soon as possible after a round has been fired. Unfortunately, a number of variable factors such as gun powder type, ambient temperature, and condition of cleanliness can influence the timing sequence of cartridge firing activities. Thus, in some conditions the spent cartridge case may not have relaxed sufficiently to eliminate or sufficiently diminish its gripping relation with the internal wall surface of the cartridge chamber. In this condition the extractor mechanism of the firearm may not be capable of extracting the stuck cartridge case, but rather may pull through the soft metal of the rim, thus leaving the spent cartridge case within the cartridge chamber. This result renders the firearm inoperative until such time as the spent cartridge is removed. At times the extractor will extract the spent cartridge case from the cartridge chamber but rearward movement of the bolt mechanism will have been slowed by the extraction force or bolt actuation force so that the spent and extracted cartridge is not completely ejected from the receiver of the firearm. The spent cartridge can then become an impediment to the loading of a fresh cartridge, thus resulting in a jam that must be cleared before normal cycling of the auto-loading mechanism can occur.

It is desirable, according to the present invention, that little or no cartridge gas pressure enter between the internal wall surface of the cartridge chamber and the external surface of a cartridge case. For this reason the tapered support shoulder 24 and the cylindrical neck support surface 26 of the cartridge chamber will not have lands or relief areas, but will have conventional configurations. The neck support region of the cartridge chamber will be of cylindrical configuration and the shoulder support surface within the cartridge chamber will have a smooth, substantially frusto-conical configuration. Thus, the cartridge case expansion that occurs just as the bullet is ejected and starts its travel through the bore, will develop a surface-to-surface mechanical seal at the neck and shoulder of the cartridge that is quite effective to prevent substantial incursion of cartridge gas pressure along the external surface of the cartridge case. This feature ensures that the spent cartridge cases are in a substantially clean and unmarred state when extracted and ejected so that they are easily cleaned and reloaded numbers of times before needing replacement.

Weather conditions are highly influential on the timing features of firing activities. However, tactical firearms must be capable of accommodating temperatures having a wide range of effective firing from about −30 degrees F. to about 200 degrees F. It is also desirable to provide for efficient extraction of spent cartridges even during adverse weather conditions which might otherwise cause cartridge sticking in a cartridge chamber. According to the present invention and as shown in FIG. 1, the internal tapered cartridge body support surface of the cartridge chamber is provided with extraction technology which effectively reduces the physical contact area of a cartridge case with the internal surface of a cartridge chamber, thus rendering a spent cartridge case more easy to extract regardless of the conditions as compared with conventionally shaped cartridge chambers.

Cartridge chambers are typically machined in firearm barrels by means of a reaming activity which leaves an internal cartridge chamber finish that may be quite rough. This rough internal finish permits the exterior surface of a cartridge case to be deformed into the rough finish as the cartridge case is rapidly expanded by cartridge gas pressure. This activity establishes a gripping characteristic where the expanded cartridge case is gripped or retained within the cartridge chamber and resists forces to extract it. When so expanded, the force needed to extract a spent cartridge case can cause damage to or excessive wear of the cartridge case or to the extractor mechanism of the firearm.

According to the cartridge case extraction technology of the present invention the internal tapered cartridge body support surface 22 is treated so as to define spaced longitudinal relieved areas or scalloped regions 28 that are quite shallow, being formed into the internal wall surface of the cartridge chamber surface to a depth of from about 0.0001" to about 0.0010". This cartridge chamber treatment is accomplished by removing, either linearly or with a gentle helix, a portion of the chamber reamer's remaining surface finish. Between the relieved or scalloped regions are longitudinal lands 30 that represent the remaining portions of the internal tapered surface of the cartridge body support surface of the cartridge chamber prior to application of the cartridge case extraction technology. The width of the relieved or scalloped regions 28 is intended to be from two to four times the width of the lands and has edge portions that merge smoothly with the edges of adjacent lands. The depth of the relieved regions is only a maximum of about 0.0010", thus the relieved regions and the wide, gently sloping lands are quite different in geometry and function, as compared with the deep cartridge chamber grooves that are evident in the prior art. However, it is to be understood that this particular range of scallop or relief depth and width and the width of the lands is not intended to limit the spirit and scope of the present invention. The longitudinal relieved regions and lands are preferably of spiral or helical configuration as shown in FIG. 1. However, the longitudinal relieved regions and lands may be straight, i.e., parallel with the longitudinal axis of the cartridge chamber or may have a reverse helical or spiral configuration as compared with the illustration of FIG. 1.

The purpose of relieving longitudinal regions of the interior of the cartridge chamber is to minimize the contact area of the cartridge cases with the interior surface of the cartridge chamber, thus minimizing the frictional resistance of expanded cartridge cases to the typical extraction forces that are applied to the spent cartridge cases. The spaced lands, which represent between ⅓ to ¼ of the interior surface area of the cartridge chamber, effectively reduce the cartridge chamber area in friction retaining contact with the spent cartridge case between ⅔ and ¾ of the surface area of the cartridge case. This reduced surface area effectively reduces the frictional resistance of the cartridge case so that the extraction force needed to extract the cartridge case is reduced in like manner. This feature greatly widens or extends the operation range of firearms and ammunition to a low temperature of about −30 degrees F. to a high temperature of about +200 degrees F. The wide and gently sloping internal lands also establish a gripping or frictional resistance function to control the gas pressure induced impact force that is applied to the bolt of the firearm, thus significantly enhancing the service life of the bolt mechanism and avoiding the premature bolt failure that is often experienced. When spiral lands and relieved areas are employed within the cartridge chamber, a small rotational moment of force is imparted to the cartridge case as it is beginning its rearward movement in response to the sudden force of cartridge gas pressure. This rotational moment of force functions as impedance or resistance to lessen the stress that is transmitted to the bolt mechanism, thus protecting the bolt mechanism from premature stress related failure.

The internal geometry of the cartridge chamber of the present invention rendered somewhat larger, as compared with the conventional dimension of a cartridge chamber for a particular type and caliber of ammunition, yet the external surface area of the cartridge chamber has less surface contact with a cartridge case that is present within the cartridge chamber. Machining or other methods for surface area removal or formation of depressions ensures that from ⅔ to ¾ of the internal surface area of a cartridge chamber will have little or no effect in resisting extraction of a cartridge case, even when the cartridge case is in a somewhat expanded state. The remaining lands resulting from the machining or metal forming process represent only about ¼ to ⅓ of the internal surface area of a cartridge chamber that will be in extraction resisting relation with a cartridge case. This minimal extraction resistance will permit extraction of cartridge cases even when the cartridge cases are expanded, thus permitting more efficient and rapid cycling of the cartridge handling mechanism during firing activities.

Removing the original surface portion of a typical cartridge chamber establishes small regions between the internal surface of the cartridge chamber and the external surface of a cartridge case that contain small quantities of air. As the cartridge case is expanded by cartridge gas pressure the air is compressed and functions as an air cushion and as an air spring, serving to urge the cartridge case toward its contracted or normal configuration. This feature also assists in minimizing the magnitude of the extraction force that is necessary for extracting cartridge cases even when they have not yet contracted to their original configuration. Thus, a firearm incorporating this cartridge case extraction technology will readily handle ammunition over a wide range of temperature conditions, from very cold to very hot, and will provide the firearm with the capability for more rapid cycling during firing activities.

Tactical firearms must be sufficiently reliable to function properly under both cold and hot conditions. Under colder conditions the gunpowder of the ammunition will tend to burn slowly and at higher temperatures the gunpowder will tend to burn faster. These gunpowder burning rates will tend to cause the timing of cartridge ejection to be slower or faster. If the ejection timing of a firearm is too fast, the cartridge case may not have had sufficient time for contraction from its fully-expanded condition so that the extractor mechanism may be unable to extract the spent cartridge case from a conventional cartridge chamber. However, when the cartridge chamber embodies the principles of the present invention the diminished surface contact area between the internal geometry of the cartridge chamber and the cartridge will permit efficient extraction of a spent cartridge case because friction retention of the cartridge case will have been diminished by as much as ¾ by the extraction treatment of the cartridge chamber by the present invention.

If desired, the relieved areas and lands may also extend along the tapered shoulder support surface and partially along the cylindrical neck support surface portion of the cartridge chamber. However, the relieved regions must not extend completely to the end of the cylindrical neck support surface since of the cartridge chamber since it is necessary that no gas channels exist within the cartridge chamber at the neck of the cartridge case. This feature permits the forward end of the neck portion of a cartridge to have surface-to-surface engagement with the corresponding cylindrical neck support portion of the cartridge chamber. A seal is developed between these cylindrical surfaces.

The absence of any gas channel geometry at the forward end of the cartridge neck support surface 26 is necessary so that the neck of the cartridge case will establish a sufficient surface-to-surface seal with the neck support surface 26 of the cartridge chamber that cartridge gas and the debris it contains will be prevented from entering the interface between the cartridge case and the internal wall surface of the cartridge chamber. Thus, the spent cartridge case is not capable of being pressure balanced and cartridge gas and its debris will be substantially excluded from the interface between the exterior surface of the spent cartridge and the corresponding internal surfaces of the cartridge chamber 20.

The cartridge case extraction technology of the present invention is generally accomplished by machining along the tapered inner surface of a standard cartridge chamber of a firearm barrel, the machining removing a portion of the standard chamber reamer finish which typically has some degree of roughness. Metal is removed in the range of between 0.0001" and 0.0010" to establish the longitudinal relieved areas which is barely perceptible from the standpoint of physical feel. However, this metal removal is sufficient to generate spaced longitudinal relief areas within the cartridge chamber that extend from the rim support surface portion 32 of the cartridge chamber to the inclined shoulder support surface 24, leaving spaced longitudinal lands between the longitudinal relieved areas. Alternatively, cartridge chamber preparation may be accomplished by electrical discharge machining (EDM), by electrochemical machining (ECM), by hammer forging or by any other suitable means that is capable of yielding quality results.

The longitudinal lands actually provide most of the friction-resisting contact area of a cartridge case with the inner surface portion of the cartridge chamber and this friction-resisting contact area is diminished by ⅔ to ¾, thus promoting ease of cartridge case extraction even when the cartridge case remains expanded by gas pressure. Thus, even when the cartridge case has not yet contracted from its gas pressure expanded condition sufficiently to minimize frictional resistance to cartridge case extraction, the diminished contact surface area that is promoted by the presence of the longitudinal lands and relief areas promotes ease of cartridge case extraction. This feature effectively promotes effective operation of autoloading firearms over a very wide range of temperature conditions in a wide range of field conditions.

In view of the potential for excessive bolt stress and premature bolt failure in response to cartridge firing activities, as explained above, it has been determined that machining of the longitudinal lands and relief areas to a spiral configuration provides the benefit of minimized premature bolt failure due to cartridge case induced bolt thrust. The spaced spiral lands within the cartridge chamber tend to impart a rotational force moment to the cartridge case as it is moved rearwardly by cartridge gas pressure and extractor force. This small rotational force moment that is caused by the spiral lands serves to develop impedance or slight resistance to the cartridge case movement and prevents the cartridge case from flying straight back and continuing its maximum force against the bolt mechanism. The impedance saves a percentage of the stress cycle that the bolt mechanism experiences during each cartridge firing cycle due to the impact force of the cartridge case at each bullet launch. The degree of impedance or resistance to cartridge case movement is selectively controlled by the amount of twist or spiral that is machined into the cartridge chamber. A tighter spiral geometry within the cartridge chamber will result in increased impedance while a spiral that is less tight will result in less impedance. This feature permits the design of the internal geometry of the cartridge chamber to be controlled for specific impedance for specific classes of cartridges, while protecting the bolt mechanism from premature failure.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A firearm, comprising:

a receiver mechanism having trigger and firing mechanism;

a one piece barrel being mounted to said receiver mechanism and defining a barrel bore and having a breech end;

a cartridge chamber being defined formed within said breech end of said one piece barrel according to the geometry and dimension of a selected ammunition cartridge and having communication with said barrel bore, said cartridge chamber having a tapered internal body wall surface and having an internal conical cartridge case shoulder support and sealing surface and a cylindrical internal cartridge case neck support and sealing surface having circular intersection with said internal conical cartridge case shoulder support and sealing surface; and said tapered internal body wall surface being defined by a plurality of elongate circumferentially spaced internal elongate land surface segments having a predetermined diameter and a plurality of elongate circumferentially spaced elongate relief surface segments each being disposed between adjacent elongate circumferentially spaced internal elongate tapered land surface segments and having an internal diameter greater than said predetermined diameter and being smoothly merged longitudinally with adjacent ones of said elongate circumferentially spaced internal land surface segments.

2. The firearm of claim 1, comprising:

said circumferentially spaced internal elongate tapered land surface segments having a cumulative internal dimension of from about ¼ to about ⅓ of said generally tapered internal body wall surface of said cartridge chamber.

3. The firearm of claim 1, comprising:

said cartridge case neck support and sealing surface being of substantially cylindrical configuration and substantially preventing incursion of cartridge gas pressure into said cartridge chamber upon firing of a cartridge.

4. The firearm of claim 1, comprising:

said internal cartridge case shoulder support and sealing surface being of annular substantially conical configuration and extending from said generally tapered internal body wall surface to said cartridge case neck support and sealing surface, said cartridge case neck support and sealing surface and said internal cartridge case shoulder support and sealing surface substantially preventing incursion of cartridge gas pressure into said cartridge chamber upon firing of a cartridge.

5. The firearm of claim 1, comprising:

said longitudinal relief surfaces having a maximum depth in the range of from about 0.0003" to about 0.0010" and having edge portions merging smoothly with said generally tapered internal body wall surface.

6. The firearm of claim 1, comprising:

said circumferentially spaced internal elongate tapered land surface segments and said longitudinal relief surface segments each having substantially straight edges.

7. The firearm of claim 1, comprising:

said circumferentially spaced internal elongate land surface segments and said longitudinal relief surface segments each having edges of spiral configuration.

8. The firearm of claim 1, comprising:

said circumferentially spaced internal elongate land surface segments having a cumulative internal dimension of from about ¼ to about ⅓ of said generally tapered internal body wall surface of said cartridge chamber;

said cartridge case neck support and sealing surface being of substantially cylindrical configuration;

said internal cartridge case support and sealing shoulder surface being of annular substantially conical configuration and extending from said generally tapered internal body wall surface to said cartridge case neck support surface and having substantially circular intersection with said cartridge case neck support and sealing surface; and said longitudinal relief surfaces having a maximum depth in the range of from about 0.0003" to about 0.0010" in relation with said internal elongate land surface segments of said generally tapered internal body wall surface.

9. The firearm of claim 8, comprising:

said firearm being of the autoloading type, having bolt and extractor mechanisms;

said plurality of circumferentially spaced internal lands develop sufficient impedance to rearward cartridge case movement within said cartridge chamber on cartridge firing to minimize the mechanical stress to which the bolt and extractor of the firearm are subjected and thus minimize bolt and extractor failure.

10. A one piece barrel of a firearm, comprising:

a barrel bore being defined within said barrel;

a cartridge chamber being defined within said barrel and having communication with said barrel bore, said cartridge chamber having a tapered internal body wall surface, said cartridge chamber having a conical cartridge case shoulder support and sealing surface extending from said tapered internal body wall surface and having a cartridge case neck support and sealing surface having substantially circular intersection with said conical cartridge case shoulder support and sealing surface, said conical cartridge case shoulder support and sealing surface and said cartridge case neck support and sealing surface providing sealing with a cartridge and substantially preventing incursion of cartridge gas pressure into said cartridge chamber upon cartridge firing; and said generally tapered internal body wall surface of said cartridge chamber being defined by a plurality of circumferentially spaced internal elongate land surface segments having a predetermined diameter and a plurality of elongate circumferentially spaced internal relief surface segments having an internal diameter greater than said predetermined diameter and having edges being smoothly merged and contiguous with adjacent ones of said elongate circumferentially spaced internal land surface segments.

11. The one piece barrel of claim 10, comprising:

said cartridge case neck support and sealing surface being of substantially cylindrical configuration;

said internal cartridge case shoulder support and sealing surface being of annular substantially conical configuration and extending from said generally tapered internal body wall surface to said cartridge case neck support surface; and said longitudinal relief surfaces having a maximum depth in the range of from about 0.0003" to about 0.0010" and having edge portions merging smoothly with said circumferentially spaced internal elongate land surface segments of said generally tapered internal body wall surface of said cartridge chamber.

12. The one piece barrel of claim 10, comprising:

said circumferentially spaced internal elongate land surface segments and said longitudinal relief surfaces each having substantially straight edges.

13. The one piece barrel of claim 10, comprising:

said circumferentially spaced internal elongate land surface segments and said longitudinal relief surfaces each having edges of spiral configuration.

14. The one piece barrel of claim 10, comprising:

said longitudinal relief surfaces constituting from about ⅔ to about ¾ of the internal surface area of the tapered body support portion of the cartridge chamber.

15. The one piece barrel of claim 10, comprising:

said circumferentially spaced internal elongate land surface segments having a cumulative internal dimension of from about ¼ to about ⅓ of said generally tapered internal body wall surface of said cartridge chamber;

said cartridge case neck support surface being of substantially cylindrical configuration;

said internal cartridge case shoulder surface being of annular substantially conical configuration and extending from said generally tapered internal body wall surface to said cartridge case neck support surface; and said longitudinal relieved areas having a maximum depth in the range of from about 0.0003" to about 0.0010" in relation with said generally tapered internal body wall surface.

16. The one piece barrel of claim 10, comprising:

said firearm being of the autoloading type, having bolt and extractor mechanisms;

said plurality of circumferentially spaced internal lands develop sufficient impedance to rearward cartridge case movement within said cartridge chamber on cartridge firing to minimize the mechanical stress to which the bolt and extractor of the firearm are subjected and thus minimize bolt and extractor failure.

17. The one piece barrel of claim 10, comprising:

said internal cartridge case support shoulder and sealing surface being of annular substantially conical configuration and extending from said generally tapered internal body wall surface to said cartridge case neck support and sealing surface; and said cartridge case neck support and sealing surface of said cartridge chamber being of cylindrical configuration and establishing a substantial surface to surface seal with the external cylindrical neck surface of a cartridge case responsive to gas pressure expansion of the cartridge case upon firing and substantially preventing incursion of cartridge gas between the cartridge case and said cartridge chamber.

18. A firearm barrel having a one piece breech end and a barrel bore, comprising:

a cartridge chamber being defined within said one piece breech end and having an internal configuration corresponding to the external configuration of the cartridge case of an ammunition cartridge and having a tapered body wall surface an internal conical cartridge case shoulder support and sealing surface and a cylindrical cartridge case neck support and sealing surface;

said tapered body wall surface being partially defined by a plurality of substantially evenly spaced internal elongate tapered land surfaces having longitudinal edges and being engaged by a correspondingly tapered cartridge case positioned within said cartridge chamber; and said tapered internal body wall surface being partially defined by a plurality of substantially evenly spaced elongate tapered relief surfaces having longitudinal edges merging smoothly with said longitudinal edges of said elongate tapered land surfaces and extending radially outward beyond said evenly spaced elongate tapered land surfaces and having spaced relation with a tapered cartridge case positioned within said cartridge chamber.

19. The firearm barrel of claim 18, comprising:

said substantially evenly spaced internal elongate land surfaces having a cumulative internal dimension of from about ¼ to about ⅓ of said tapered internal body wall surface of said cartridge chamber; and said substantially evenly spaced elongate tapered relief surfaces having a maximum depth in the range of from about 0.0003" to about 0.0010" in relation with said substantially evenly spaced internal elongate land surfaces.

* * * * *